United States Patent [19]

Tarumi et al.

[11] 4,417,871

[45] Nov. 29, 1983

[54] METHOD AND APPARATUS FOR COOLING SKID PIPES IN CONTINUOUS SLAB REHEATING FURNACE

[75] Inventors: Mitio Tarumi, Hirakata; Tetsuya Tokitsu, Takarazuka; Yoshio Matsumoto, Takatsuki, all of Japan

[73] Assignee: Chugai Ro Kogyo Co., Ltd., Osaka, Japan

[21] Appl. No.: 359,991

[22] Filed: Mar. 19, 1982

[51] Int. Cl.[3] ..... F27D 3/02; F25B 29/00; F28D 13/00

[52] U.S. Cl. ..... 432/1; 165/31; 165/104.32; 432/234

[58] Field of Search ..... 432/233, 234, 1; 165/31, 104.32

[56] References Cited

U.S. PATENT DOCUMENTS

| | | | |
|---|---|---|---|
| 3,165,145 | 1/1965 | Spaenig et al. | 165/104.32 |
| 3,457,523 | 7/1969 | Wesselink | 165/104.32 |
| 3,586,299 | 6/1971 | Foldessy | 432/234 |

*Primary Examiner*—John J. Camby
*Attorney, Agent, or Firm*—H. Duane Switzer

[57] ABSTRACT

An apparatus is disclosed for cooling the skid pipes of a continuous slab reheating furnace by the circulation of pressurized hot water, not cold water or steam, through the skid pipes where the hot water is heated to even higher temperatures. The heated hot water is relatively cooled by passage through a heat exchanger, after which the relatively cooler hot water is recirculated to the skid pipes. Means are provided for keeping the hot water under a pressure sufficient to maintain the hot water in a liquid state and prevent its evaporation into steam, as the hot water circulates through the apparatus, especially the skid pipes of the furnace.

2 Claims, 1 Drawing Figure

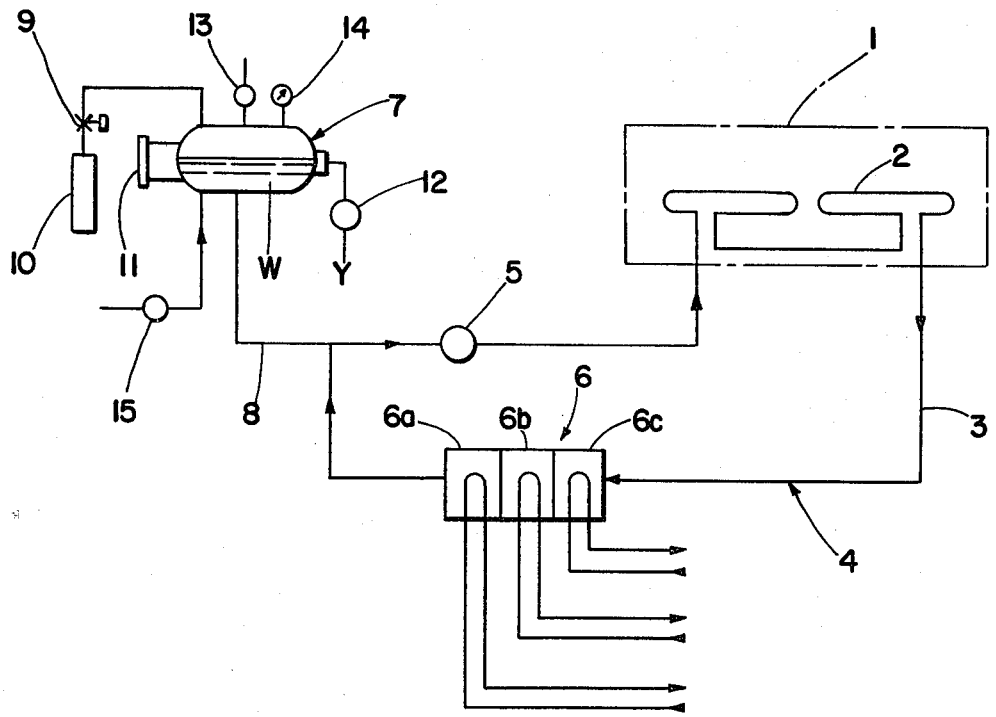
9
13
14
7
1
2
12
10
11
W
Y
5
15
8
6
6a
6b
6c
3
4

METHOD AND APPARATUS FOR COOLING SKID PIPES IN CONTINUOUS SLAB REHEATING FURNACE

BACKGROUND OF THE INVENTION

This invention relates to an apparatus for cooling skid pipes in a continuous slab reheating furnace. The conventional method for cooling the said skid pipes was such that coolant such as cooling water was passed inside refractory insulating material covering the skid pipes. But evaporative cooling or the method of recirculating coolant requires large-size equipment of complicated structure partly because of necessity of a countermeasure for leakage and safety aid.

In another method of passing water as coolant, thermal energy of cooling water is not utilized at all and there is great heat loss from the furnace as the skid pipes are cooling to 30° to 50° C. with cooling water. In addition to these thermal problems, there is a disadvantage that the cooling effect drops due to the precipitation of such salts as calcium and silica, and formation of scale inside the skid pipes during a long period of use.

This invention, intended to eliminate defects of the said conventional cooling methods, provides an apparatus for cooling skid pipes in a continuous slab reheating furnace, in which hot water made high in temperature in the skid pipes is cooling by heating other fluid through heat exchangers provided in a closed circuit formed with a passage inside the skid pipes made part of a hot water circulating passage so that the skid pipes may be protected, without reducing the temperature of the circulating hot water too much and with effective utilization of heat and minimized furnace heat loss, and the precipitation of calcium and silica in the piping may be minimized by circulating processing water in the closed circuit.

DETAILED DESCRIPTION OF THE DRAWING

This invention will be explained as follows according to an example of practice.

On the attached diagram, 1 is a reheating furnace.

2 is skid pipes having a hot water passage inside them. These skid pipes 2 in combination with piping 3 are made part of a closed circulating passage 4 equipped with a circulating pump 5 and heat exchangers 6 (*6a, 6b,* and *6c*). 7 is a closed reservoir tank consisting of an expansion tank. Hot water W inside the tank 7 passes through piping 8 which communicates with the said piping 3.

The said tank 7 communicates with a nitrogen gas bottle 10 through a regulator 9. The bottle 10 supplies given pressure to the said closed circulating passage 4.

11, 12, 13, 14 and 15 are a level controller, an overflow trap, a safety valve, a pressure gauge and a fresh water supply pump.

As the cooling apparatus according to this invention is of the above-mentioned construction, hot water W is fed by the circulating pump 5 into the skid pipes 2 thereby cooling the skid pipes 2 where hot water W is heated to approx. 200° C.

Then hot water W is cooling to approx. 190° C. by heat exchange with, for example, combustion air, fuel and water in the heat exchangers *6a, 6b* and *6c,* and recirculates as mentioned above.

Hot water W cooled in the said recirculation is heated by the skid pipes 2. To compensate for reduction of the recirculating hot water, the closed reservoir tank 7 supplies hot water W.

As clarified by the above description, this invention enables thermal energy to be effectively utilized as hot water heated to a high temperature while cooling skid pipes is used to heat other fluid through heat exchangers.

Further as the skid pipes are cooled by high temperature hot water, there is less temperature differential than the conventional systems. This reduces the drop of the furnace temperature, thereby reducing furnace heat loss.

There is another advantage that the precipitation of calcium and formation of sludge in piping including skid pipes can be minimized, as clarified hot water is used in circulation.

The temperature of circulating hot water can be changed by changing system pressure, and piping etc. can be compact as hot water is not evaporated.

If the closed reservoir tank is filled with high pressure nitrogen gas, dissolution of oxygen into hot water can be prevented.

What is claimed:

1. An apparatus for cooling a plurality of hollow skid pipes disposed in a continuous slab reheating furnace, the apparatus comprising:

(a) at least one heat exchanger;

(b) a water circulating pump;

(c) a piping circuit which connects the skid pipes, heat exchanger and circulating pump in series with each other in a closed loop;

(d) a closed, hot water storage tank;

(e) piping means for providing direct fluid communication between the piping circuit and the storage tank such that the piping circuit and storage tank are in pressure equilibrium, the piping means connecting the storage tank with the piping circuit between the heat exchanger and the circulating pump such that the storage tank is external of the piping circuit closed loop;

(f) water level control means for maintaining a substantially constant water level in the storage tank;

(g) nitrogen supply means for supplying nitrogen to the storage tank to inhibit dissolution of oxygen into hot water in the storage tank; and, (h) temperature control means for selecting the temperature of circulating hot water, the temperature control means including a nitrogen pressure regulator for regulating nitrogen pressure in the storage tank such that controlling the pressure of nitrogen in the storage tank controls pressure in the closed loop piping circuit which controls the temperature of circulating hot water.

2. A method for cooling skid pipes of a continuous slab reheating furnace, the method comprising:

supplying clarified water at generally 190° C. to the skid pipes;

passing the water through the skid pipes at a rate and pressure which causes the water to be heated to generally 200° C.;

cooling the 200° C. water to generally 190° C. and recirculating the 190° C. water back to the skid pipes;

maintaining a hot water-nitrogen interface in fluid communication with the recirculating hot water to prevent dissolution of oxygen into the hot water; and, adjusting nitrogen pressure at the hot water-nitrogen interface to adjust the hot water pressure in the skid pipes such that the temperature of the recirculating hot water is also adjusted.

* * * * *